US006834868B1

(12) United States Patent
Blackburn

(10) Patent No.: US 6,834,868 B1
(45) Date of Patent: Dec. 28, 2004

(54) TRANSFORMABLE CREEPER

(75) Inventor: John H. Blackburn, Greenville, SC (US)

(73) Assignee: Sunex International, Inc., Greenville, SC (US)

( * ) Notice: Subject to any disclaimer, the term of this patent is extended or adjusted under 35 U.S.C. 154(b) by 85 days.

(21) Appl. No.: 10/227,133

(22) Filed: Aug. 23, 2002

(51) Int. Cl.[7] ..... B25H 5/00
(52) U.S. Cl. ..... 280/32.6; 280/641
(58) Field of Search ..... 280/32.5, 32.6, 280/638, 639, 641, 79.11; 297/16.1, 16.2; 5/627, 625, 626, 110, 111, 112, 114; D34/23

(56) References Cited

U.S. PATENT DOCUMENTS

| | | | | | |
|---|---|---|---|---|---|
| 1,820,284 | A | * | 8/1931 | Mills | 119/28.5 |
| 1,820,285 | A | * | 8/1931 | Mills | 5/187 |
| 2,595,783 | A | | 5/1952 | Griffin | |
| 4,895,380 | A | * | 1/1990 | Brooks et al. | 280/32.6 |
| 5,451,068 | A | * | 9/1995 | Shockley | 280/32.6 |
| 5,611,552 | A | * | 3/1997 | Miles et al. | 280/32.6 |
| 5,707,067 | A | | 1/1998 | Smith | |
| RE35,732 | E | | 2/1998 | Shockley | |
| D431,705 | S | * | 10/2000 | Yuan | D34/23 |
| 6,199,877 | B1 | * | 3/2001 | Shockley | 280/32.6 |
| 6,425,590 | B1 | * | 7/2002 | Whiteside et al. | 280/32.6 |

OTHER PUBLICATIONS

Page S40, MAC Tools Catalog, published at least as early as Dec. 31, 2000.
Page 284, MAC Tools Catalog, published at least as early as Dec. 31, 2000.

* cited by examiner

*Primary Examiner*—Bryan Fischmann
(74) *Attorney, Agent, or Firm*—Dority & Manning, P.A.

(57) ABSTRACT

A transformable creeper includes a base section and a head section. The base section and head section are positioned generally in a same plane in a supine position of the creeper. The head section is movable by way of at least one pair of pivotally mounted arms from the supine position into a seat position wherein the head section is disposed above the base section. A support member extends across a frame of the base section proximate to a transverse end thereof. The head section includes an end member that is longitudinally distanced from the ends of the head section frame and which rest on and is supported by the base section support member in the supine position of the creeper. A pair of spaced apart, downwardly projecting bumpers depend from an end rail that forms one extreme end of the head section.

12 Claims, 6 Drawing Sheets

TRANSFORMABLE CREEPER

CROSS-REFERENCE TO RELATED APPLICATIONS

N/A

STATEMENT REGARDING FEDERALLY SPONSORED RESEARCH OR DEVELOPMENT

N/A

BACKGROUND OF THE INVENTION

The present invention relates to a creepers, such as an automotive mechanic's creeper, and more particularly to a creeper that is transformable between a supine configuration and an upright seat configuration.

Creepers that transform or convert from a generally flat or supine position to an upright or seat position are known in the art. For example, U.S. Pat. No. 5,451,068 to Shockley (Reissued as RE 35,732) describes such a transformable creeper having an elongated frame that includes a base and a seat assembly interconnected by at least one interlinking connector. The interlinking connector has a first end pivotally connected to the seat assembly. In order to transform the creeper from the supine position to the seat position wherein the seat assembly is positioned generally in vertical alignment with the base, it is necessary to remove an insert pad that is carried by the creeper frame to enable the interlinking connector to pivot and raise the seat assembly above the base assembly.

U.S. Pat. No. 5,707,067 describes another type of transformable creeper having a central platform and an end platform on each side of the central platform. The three platforms form a full-length creeper in a first creeper mode. The central platform becomes a work seat and the two end platforms slide together in an edge-to-edge configuration to form a shelf or platform under the work seat in a second seat mode of the creeper. So that the two end platforms can be slid together under the central platform, the end platforms are in sliding attachment with slide rods disposed in slideways.

U.S. Pat. No. 2,595,783 to Griffin discloses an early transformable creeper having a main frame and an end frame. Casters are attached to the bottom of the main frame to support the frames and provide mobility to the creeper. The end frame is swung upwardly for use as a seat. In this manner, support arms are pivotally connected to the main frame at one end and to the end frame at the other. For attachment to the end frame, a guide plate having slots formed therein is attached to the undersurface of a support pad carried by the end frame. The slots permit the support arms to remain in engagement with the pad as the end frame is swung downwardly from its seat position to the creeper position.

FIGS. 1A and 1B illustrate a prior art transformable creeper. As can be seen from FIGS. 1A and 1B, this prior art creeper comprised two sections of generally equal length. One section was movable to a position above a base sections in a seat position of the creeper by way of pivotally mounted arm members. To transform the creeper into a supine or flat position, the safety latch mechanism was released and the upper section was pivoted to align with the base section. As can be seen from FIGS. 1A and 1B, transverse ends of the base and head section frames and cushions would be disposed directly adjacent in the supine position. Due to the overall length of the head section and the fact that the head section was not otherwise supported by the base section, wheels or castors were placed on the head section to support the head section in the supine position and allow the creeper to be mobile in the supine position.

A prior art transformable creeper shown in FIGS. 1A and 1B also included a two-section frame assembly wherein a seat sec tion and base section having generally the same length were interconnected by two pairs of pivotally attached arms. In this manner, the seat section could be raised into an upper or seat position and be aligned vertically above the base section. Casters or wheels were provided on the base section to support the creeper in both the supine position and with the seat section raised above the base section. A single downwardly projecting post is disposed to depend from the middle of the underside of an end rail that defines the forward edge of the seat section. In the event that a weight is placed on the extreme end of the creeper when configured in the supine position, the post may touch the floor and prevent extreme tipping of the forward end of the seat section of the creeper.

The present inventive creeper combines many of the advantages of the types of creepers discussed above in a relatively simple design that also eliminates many of the shortcomings of the conventional creepers.

OBJECTS AND SUMMARY OF THE INVENTION

It is therefore a principal object of the present invention to provide an improved transformable creeper of the type that can be configured between a horizontal supine position and an upright seat position.

Additional objects and advantages of the invention will be set forth in part in the following description, or may be obvious from the description, or maybe learned through practice of the invention.

In accordance with the invention, a transformable creeper is provided having a two-section longitudinally extending frame. The frame comprises a base section and a head section. The head section is pivotally connected to the base section. When oriented in a supine position of the creeper, the base section and head section are positioned generally end-to-end in the same horizontal plane. To transform the creeper into a seating configuration, the head section is movable from the supine position to a position above the base section. It may be preferred that the end of the head section vertically aligns with the base section in the seating configuration so that a mechanic may position his legs on this vertically aligned side of the creeper in the seating configuration. The head section preferably has a length that is less than the length of the base section.

Each of the base section and the head section defines an upper body support surface having transverse ends. In other words, the ends extend generally perpendicular to the longitudinal sides of the head and base sections. In the supine configuration of the creeper, the support surfaces are generally flush with adjacently disposed transverse ends.

So that the head section can be supported by the base section without the necessity of configuring casters or other support members on the head section, the base section includes a transverse support member upon which the head section rests in the supine position of the creeper. For example, at least a portion of the head section extending longitudinally beyond the ends of the head section frame may rest upon and be supported by the transverse support member of the base section in the supine position of the creeper.

In a preferred embodiment, at least one pair of pivotally mounted arms interconnects the base section and the head section. The arms have a length and pivotal connection points relative to the base section and head section such that in the seating configuration, the head section is disposed above and brought to a position such that the transverse end that was adjacent to the base section in the supine position is generally vertically aligned with the end of the base section.

Preferably, the base section and head section comprise tubular frame components formed in an open-end configuration having longitudinally extending sides terminating in side ends. The side ends are adjacent and longitudinally aligned in the supine position of the creeper. The transverse support member of the base section may be disposed across the tubular frame components proximate to the respective side ends of the base section. In this embodiment, the head section may comprise an end member that extends between and is longitudinally distanced from the respective side ends of the head section frame components. The end member is supported upon the transverse support member in the supine position of the creeper.

Preferably, a plurality of rolling members, such as wheels or casters, are disposed on the base section so that the creeper is rollable or mobile, whether it is configured in the supine position or the seat position. Due to the unique interengaging supporting structure of the head and base sections, it is not necessary to provide such rolling members on the head section. It may be preferred, however, to provide a pair of spaced apart, downwardly projecting bumpers, or other similar devices, on the head section. The desirable position for each bumper is on the end rail nearest where the end rail meets the adjoining side rail. In the event that a weight or other object is placed on the extreme end of the creeper in the supine position, the bumpers prevent undue tilting of the seat section that might cause a workman stepping on the seat section to lose balance and fall over.

In a preferred embodiment, the body support surfaces of the head and base sections comprise cushions. The head section cushion may further include a rigid cushion base member. This base member may form the portion of the head section supported by the transverse support member of the base section. For example, the rigid base member may extend longitudinally beyond and transversely inward of the ends of the head section frame sides. Thus, when the head section is lowered into the supine position, the rigid cushion base member will rest upon the transverse support member with the cushions being flush and the side ends of the respective frame components being flush and aligned at a position longitudinally distanced from the aligned edges of the cushions.

It may also be preferred to provide a safety latch or device on the creeper, for example disposed on the base section, to prevent inadvertent movement of the head section from the seat position back to the supine position.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, which is not restricted to the specifics of the examples. For example, features illustrated or described as part of one embodiment, can be used on another embodiment to yield a still further embodiment. It is intended that the present invention include such modifications and variations.

Figure 2:
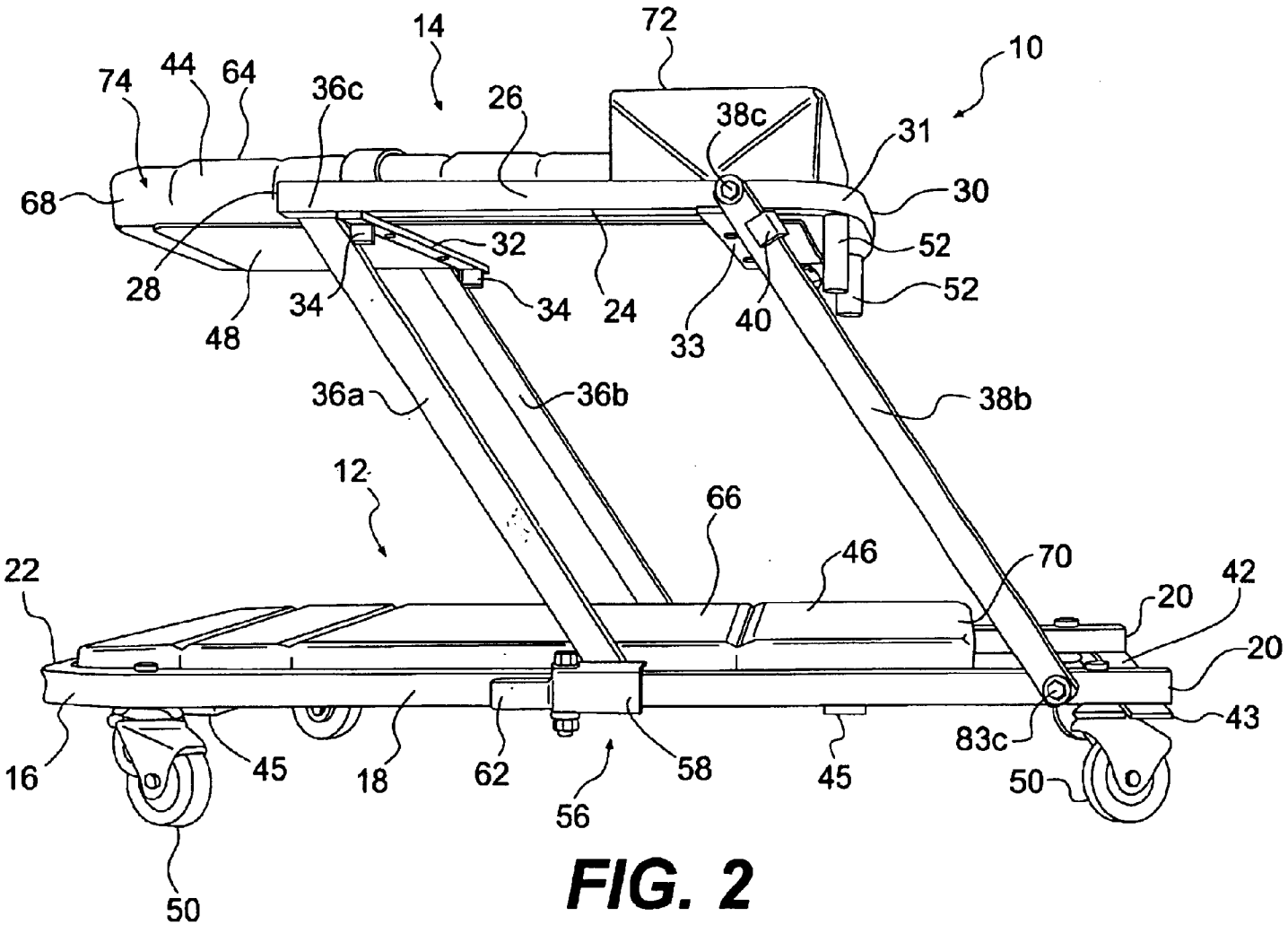
FIG. 2 is a side perspective view of a presently preferred embodiment of a transformable creeper according to the present invention.
Figure 3:
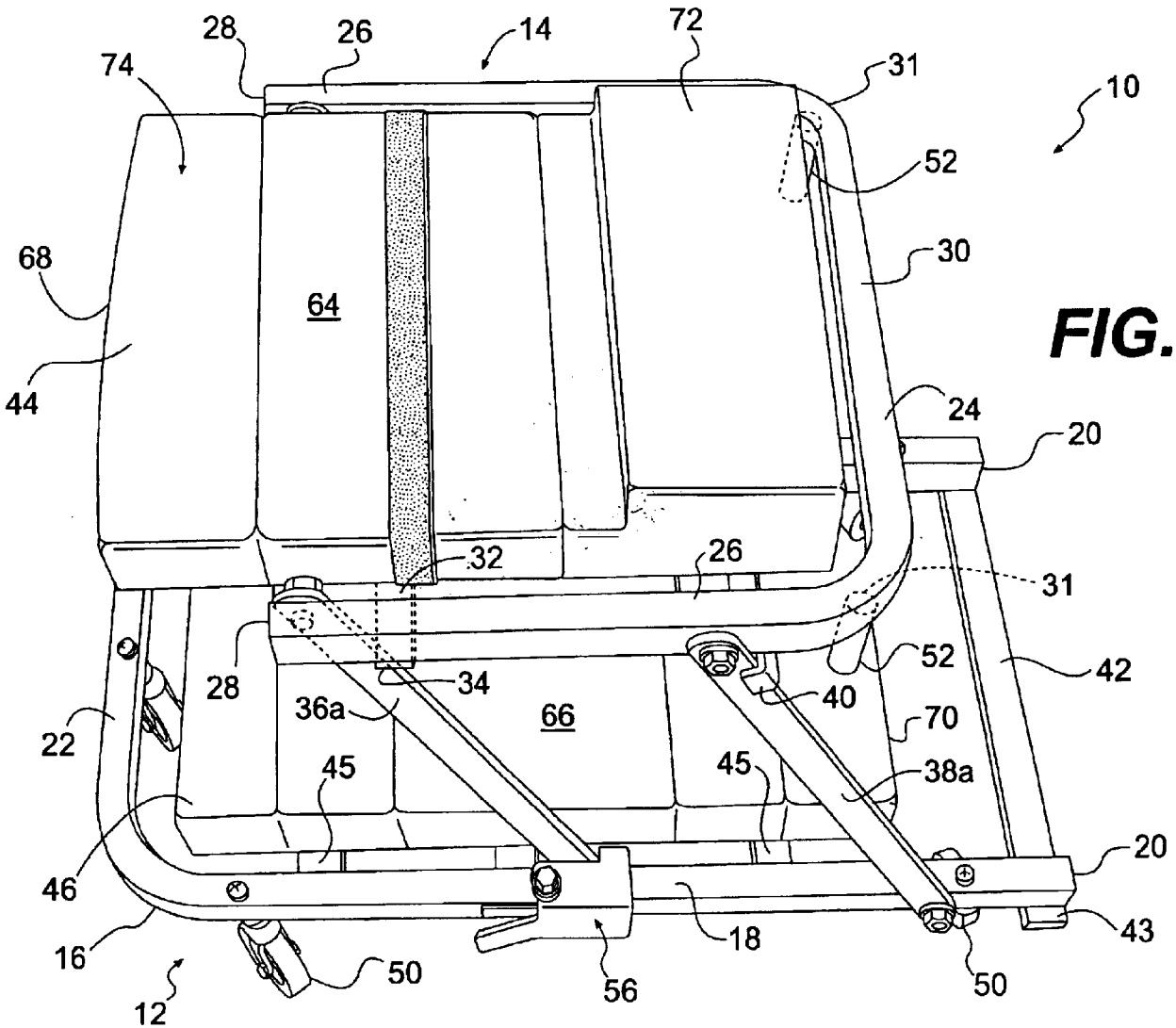
FIG. 3 is a top perspective view of the transformable creeper embodiment of FIG. 2 according to the present invention.
Figure 4:
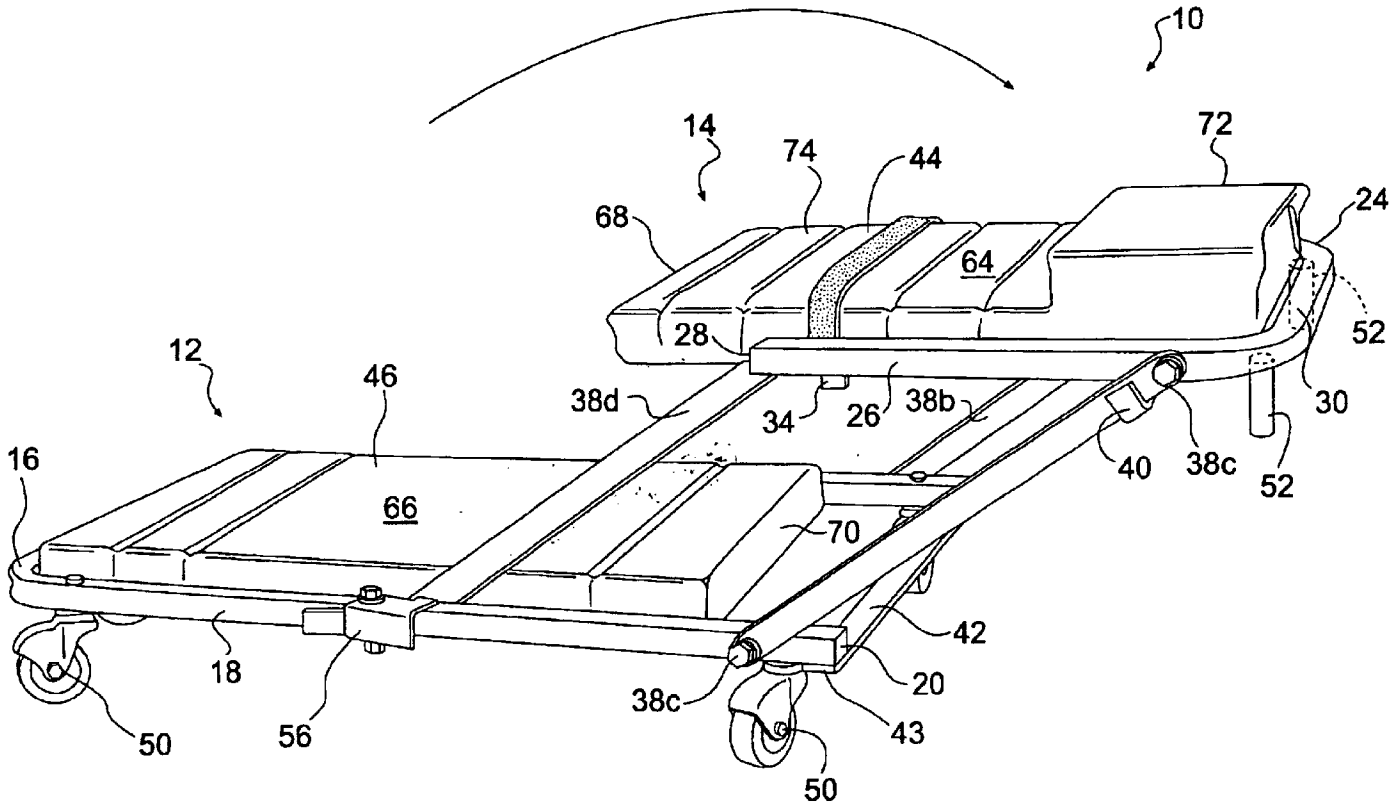
FIG. 4 is a perspective operational view of the transformable creeper embodiment of FIGS. 2 and 3.
Figure 5:
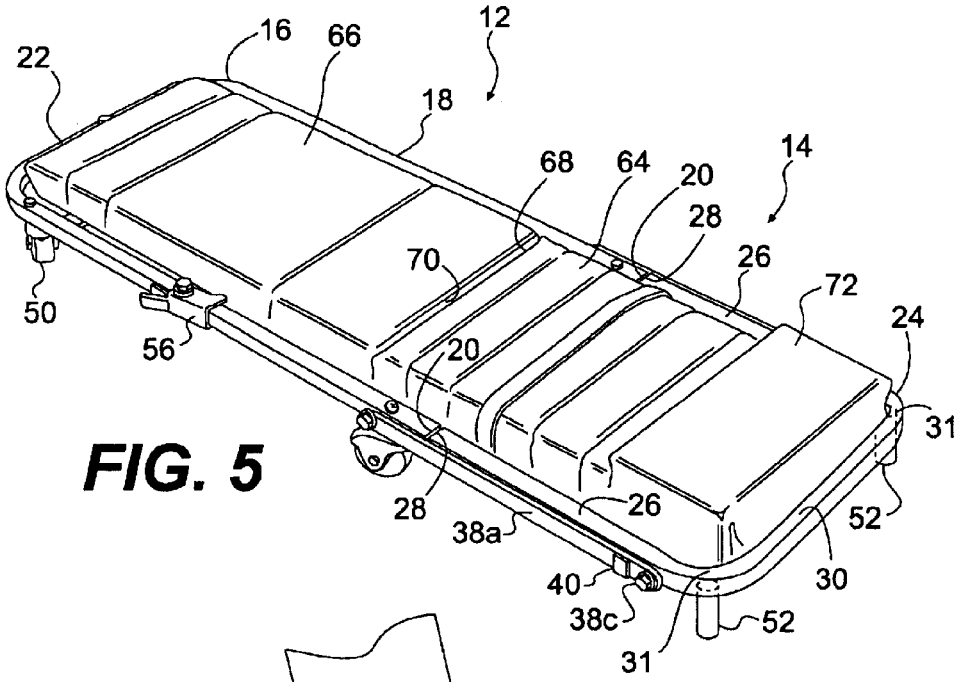
FIG. 5 is a perspective view of the transformable creeper embodiment of FIGS. 2–4 but oriented according to the supine position.
Figure 6:
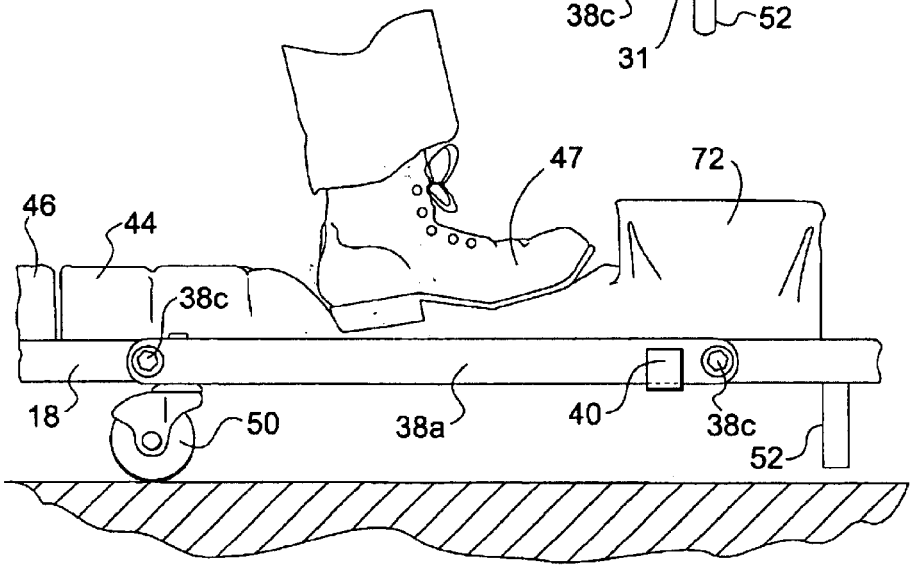
FIG. 6 is a side view of the head section of the transformable creeper of FIGS. 2–5.
Figure 7:
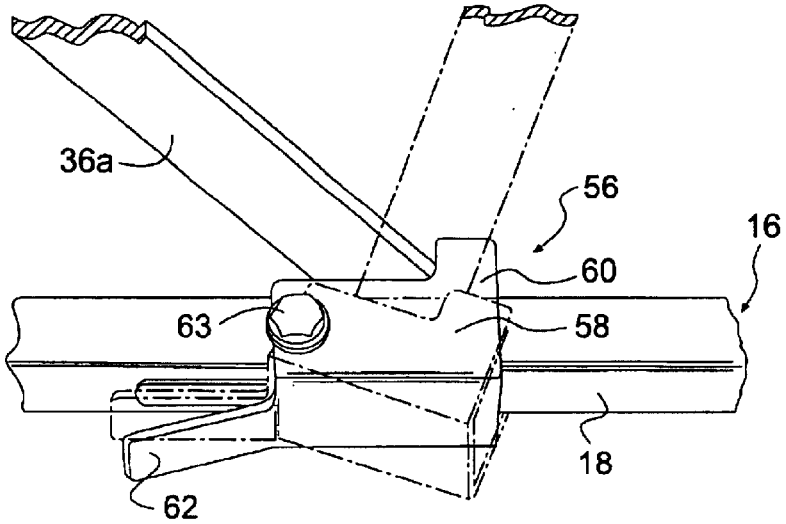
FIG. 7 is an enlarged operational view of the safety latch mechanism incorporated in the transformable creeper of FIGS. 2–6.

A presently preferred embodiment of a transformable creeper according to the present invention is illustrated generally in FIGS. 2 through 8 and is designated generally in FIG. 2 by the numeral 10. In accordance with this embodiment of the invention, creeper 10 includes two separate longitudinally extending sections, a base section 12 and a head section 14. In a presently preferred embodiment, base section 12 has a length that is greater than the length of head section 14. When creeper 10 is configured in the supine position that one normally associates with a creeper, as shown in FIG. 5 for example, base section 12 and head section 14 are positioned generally end-to-end so that their respective upper and lower surfaces are disposed in the same plane.

However, head section 14 is pivotally connected to the base section 12. As illustrated in FIGS. 2 and 3, when creeper 10 is configured in a seating position, head section 14 is disposed to a position above and parallel to base section 12. As illustrated in FIGS. 3, 4 and 5 for example, when the configuration of creeper 10 is being changed from a seating position (FIG. 3) to a supine position (FIG. 5), head section 14 is pivoted from above base section 12 to a position that is aligned and level with base section 12. When configured in this orientation with the head section 14 disposed above the base section 12, the head section 14 defines a seat for the user.

Each of the base section 12 and the head section 14 includes a frame member. The frame member of each section defines the outline of part of the creeper 10 and has opposed upper and lower surfaces that extend longitudinally in parallel planes. Base section 12 is comprised of a base frame 16 having sides 18 and side ends 20. In a preferred embodiment, base frame 16 is formed of generally tubular bent members and defines a closed end 22 and an open end opposite closed end 22. For example, base frame 16 may be formed in a generally U-shaped configuration. It should be appreciated that base frame 16 can take on any manner of configurations and be formed by any manner and configuration of frame members.

Likewise, head section 14 comprises a head section frame 24 defining sides 26 and side ends 28. As with base section frame 16, head section frame 24 may also preferably be comprised of generally tubular bent members. As shown in FIG. 3, head section frame 24 desirably defines an end rail 30 that forms the closed end of the head section frame 24. End rail 30 is disposed transversely between sides 26 and opposite from the open end defined by side ends 28. End rail 30 has opposite ends, and each of these opposite ends meets one of the sides 26. As shown in FIG. 3 for example, an elbow section 31 of the head section frame 24 is formed where each of these opposite ends of the end rail 30 meets one of the sides 26 of the head section frame 24. As shown in FIGS. 2 and 3, each of these elbow sections 31 is curved. Accordingly, each elbow section 31 desirably aligns neither with end rail 30 nor the respective connecting side 26 and is thus desirably slightly off-alignment with each of end rail 30 and each respective meeting side 26.

Transverse frame members may also be included on each of the base frame 16 and head section frame 24. For example, referring to FIG. 2, transverse frame members 32, 33 are interconnected between sides 26 of head section frame 24. Likewise, base frame 16 may include transverse frame members 45 interconnected between sides 18.

Each of base section 12 and head section 14 defines an upper body support surface. The head section upper body support surface is designated generally in FIGS. 2–5 as 64. The base section upper body support surface is designated generally in FIGS. 2–5 as 66. In the supine position of creeper 10 as illustrated in FIG. 5, the upper body support surfaces 64, 66 are generally flush and include transverse ends 68, 70, respectively. In the supine position, transverse ends 68, 70 are directly opposite each other and longitudinally aligned.

Head section 14, and particularly the upper body support surface 64 thereof, also preferably includes a head cushion 72. Head cushion 72 has a shape and configuration to support the head of the operator when lying upon creeper 10 in the supine position.

So as to provide a degree of comfort to the operator, the upper body support surfaces 64, 66 are preferably defined by cushions 44, 46, as generally illustrated in the Figs. Each cushion desirably includes a layer of resilient foam that is covered by a grease-resistant vinyl material. Head section cushion 44 is desirably supported by a generally rigid and firm cushion base 48, as particularly illustrated in FIG. 8. Cushion support base 48 may be formed of any suitable material, such as plywood, metal, hard plastic, and the like.

As shown in FIGS. 3 and 4 for example, base section 12 also includes a transverse support member, generally 42, that extends generally across base section frame 16 proximate to a transverse end of base section frame 16 and near side ends 20. When creeper 10 is oriented in the supine position, transverse support member 42 preferably forms a component of base frame 16 that extends below head section 14. In this manner, transverse support member 42 supports a portion of the head section 14 when creeper 10 is configured in the supine position. Referring particularly to FIGS. 3 and 4, it can be seen that transverse support member 42 may comprise an additional transverse frame member that is interconnected between sides 18 generally near side ends 20 of base frame 16. As shown in FIG. 4, transverse end 70 of the base upper support surface 66 is longitudinally distanced from transverse support member 42 and side ends 20 of frame 16.

Figure 8:
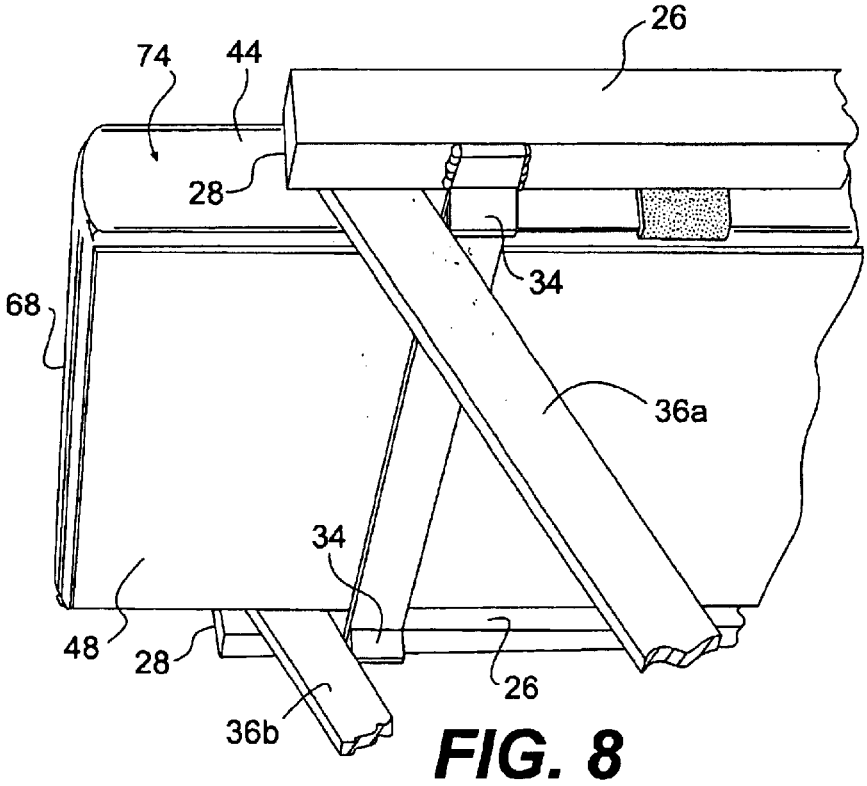
FIG. 8 is an enlarged underside view of the head section of the transformable creeper of FIGS. 2–7.

In a presently preferred embodiment shown in FIG. 8 for example, head section 12 includes an end member, generally designated 74, that is longitudinally distanced from side ends 28 of head section frame 26. End member 74 comprises the end portion of upper body support surface 64, and particularly cushion 44 with its rigid support base 48. When head section 14 is swung into the supine position, as illustrated in going from FIG. 4 to FIG. 5, end member 74 extends between sides 18 of base frame 16 and is supported on transverse support member 42. Thus, head section 14 is directly supported by the base section frame 16 in the supine position while side ends 20, 28 of the base and head section frames, respectively, are directly adjacent and aligned end-to-end in the supine position. In this manner, head section 14 can comprise a relatively long section, yet need not be supported on its underside by wheels, castors, or the like in the supine position of creeper 10.

In accordance with the present invention, a pair of spaced apart, vertically depending members is provided at the closed or forward end 30 of head section frame 24. These vertically depending members are disposed to prevent the creeper from tipping if a weight is placed near the extreme end of head section 14, as schematically exemplified in FIG. 6 by the worker's boot 47 supported atop the cushions 44 of the head section. As embodied herein and shown in FIG. 2 for example, the vertically depending members desirably are provided by a pair of rigid, spaced apart bumpers 52 or other similar devices. Each bumper 52 extends over a distance that is less than that of castors 50 of base section 12 and thus in no way inhibits the mobility of the creeper. In other words, an operator may lie upon creeper 10 in its supine position and the creeper is freely mobile on castors or wheels 50 without the necessity of providing such castors or wheels on head section 14.

Figure 1A:
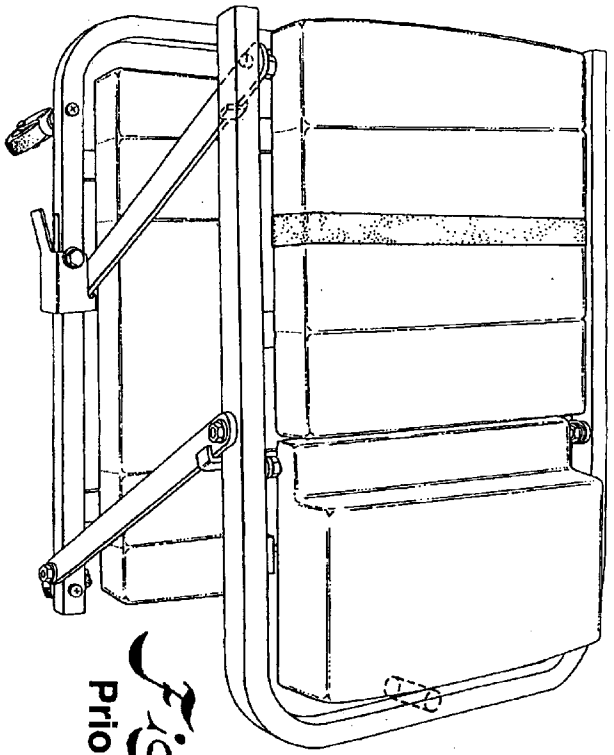
Fig. 1A Prior Art
FIG. 1A is a prior art transformable creeper that is oriented in the seating configuration and taken from an elevated perspective view above the creeper.
Figure 1B:
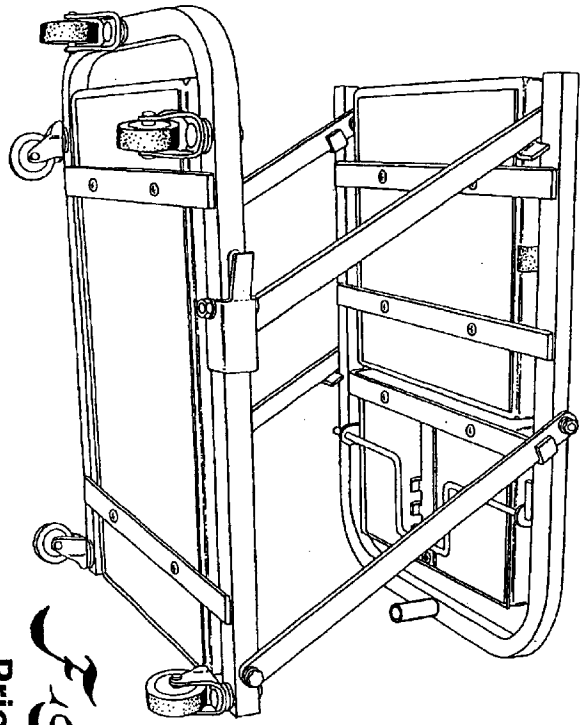
Fig. 1B Prior Art
FIG. 1B is a perspective view of the creeper of FIG. 1A, but taken from a viewpoint beneath the creeper.

In accordance with the present invention, each bumper 52 desirably is defined on and extends from one of the elbow sections 31 that is formed in the curved sections of the head section frame 24 where the opposite ends of the end rail 30 meet with the respective sides 26 of the head section frame 24. Accordingly, each bumper 52 desirably aligns neither with end rail 30 nor with the respective connecting side 26. Thus, each bumper 52 desirably is located where it is slightly off-alignment with the end rail 30 of the head section frame 24. At the same time, each bumper 52 is located where it is slightly off-alignment with each respective meeting side 26 of the head section frame 24. Thus, each bumper 52 is in non-alignment with the sides 26 and in non-alignment with the end rail 30. By such positioning of the bumpers 52, they will touch the ground sooner in response to a tilting downward force toward the sides 26 than if the bumpers 52 had been placed in alignment with the sides 26. Similarly, such positioning of the bumpers 52 enables them to touch the ground sooner in response to a tilting downward force toward the end rail 30 than if the bumpers 52 had been placed in alignment with the end rail 30 (as was the single post in the prior art creeper shown in FIGS. 1A and 1B).

It should be appreciated that the interengaging support structure between head section 14 and base section 12 in the supine position can take on any manner of configurations and shapes. For example, additional frame members may be incorporated with head section frame 24 that rest upon or are engaged by base section frame 16 in the supine position.

Creeper 10 also includes at least one pair of pivotally mounted arms, and preferably two such pairs of arms **36*a*, 36*b* and 38*a*, 38*b*. These arms are pivotally mounted to the respective head and base section frames 24, 16, for example by way of pivotal attachments 38*c*, so that head section 14 can be swung between the seating position and supine position. When two such pairs of arms are utilized, the arms have generally the same length and operate in parallel to move the head section 14** between the supine position and the seating position.

Referring to the Figs. in general, it can be seen that a plurality of rolling members, such as castors or wheels 50 are provided on base section frame 16 to provide mobility to creeper 10. As mentioned, such castors or wheels 50 do not need to be placed on head section 14.

It may also be preferred to provide a safety latch mechanism, generally 56, that prevents head section 14 from inadvertently collapsing into the supine position. Safety latch mechanism 56 may take on any manner of configuration. In the embodiment illustrated in FIG. 7, safety latch 56 includes a latch member 58 that is spring loaded by way of pivotal attachment 63 onto a side frame member 18 of base frame 16. Latch member 58 includes a transversely extending arm 60 that engages and locks against pivotal arm 36*a* in the seating position. An actuating member 62 is provided to move arm 60 out of engagement with pivotal arm 36*a* so that head section 14 may then purposefully be moved into the supine position.

The position of head section 14 in the seating position is limited by arm stops 34 provided on transverse frame member 32 of head section frame 24, as well as arm stops 40 provided on the pair of pivotal arms 38*a*. Referring to FIG. 3, it can be seen that arm stops 34 engage against arms 36*a* and arm stops 40 engage against the underside of head section frame sides 26 in the seating position, thereby defining the limit to which head section 14 can be swung. It is preferred that head section 14 swing no further than a position such that transverse end 68 of the head section does not extend longitudinally beyond the closed end frame 22 of base section 12. In this manner, the operator can easily operate creeper 10 in its seating position with his legs extending over transverse end 68 unencumbered by the base section. Also, it would be undesired to have the head section extend longitudinally beyond the base section because this arrangement would tend to cause the creeper to tip if weight were concentrated on the transverse end 68 of head section 14 in the seating position.

Arm stops 40 provided on pivotal arms 38*a* also have a shape and configuration so as to act as a carriage or support for head section frame 26 and to define the lower swing position of head section 14 in the supine position along with side extensions 42 of transverse support member 42. Referring particularly to FIGS. 3 and 4, it can be seen that side extensions 43 extend beyond base section frame sides 18 for a length that is equal to about the thickness of pivotal arms 38*a*. Thus, arms 38*a* can swing no lower than side extensions 43 and are thus prevented from swinging below the frame sections in the supine position, as illustrated in FIG. 5. Similarly, arms 36*a*, which are disposed on the opposite side of frame sides 18 from arms 38*a*, rest upon transverse frame member 45 and transverse support member 42 in the supine position. As can be seen in FIG. 3, arm stops 40 provided on arms 38*a* have a transversely extending portion that lies below and supports frame sides 26 in the supine position as well, as can be particularly seen in FIG. 6.

It should be appreciated by those skilled in the art that various modifications and variations can be made in the present invention without departing from the scope and spirit of the invention. For example, the base and head sections can be comprised by any manner of configuration of frame members or components. It is intended that the present invention include such modifications and variations as come within the scope of the appended claims and their equivalents.

What is claimed is:

1. A transformable creeper comprising:

a base section and a head section, each of said base section and said head section further comprising a longitudinally extending frame with respective sides having side ends that are adjacent and longitudinally aligned in a supine position of said creeper wherein said base section and said head section are positioned generally in a common plane, said base section having a length greater than the length of said head section;

said frame of said head section further including an end rail that extends transversely between said sides and is disposed opposite said side ends, said end rail has opposed ends, each of said opposed ends of said end rail meeting with one of said sides and forming an elbow section of said frame of said head section;

at least one pair of pivotally mounted arms interconnecting said base section and said head section such that said head section is movable from said supine position to a seating position wherein said head section is disposed above said base section and defines a seat;

a pair of bumper members defined on and vertically depending from said frame of said head section, each said bumper member being spaced apart from said other bumper member and disposed to depend from a different one of said elbow sections of said frame of said head section;

a cushion carried by each of said head section and said base section, said cushions being disposed generally directly adjacent and flush in said supine position of said creeper, the base section cushion having an end facing the head section cushion in the supine position; and a transverse support member that extends across said sides of said base section frame, the transverse support member being disposed below and adjacent to said end of the base section cushion.

2. The transformable creeper as in claim 1, further comprising a rigid cushion base member supporting said head section cushion, said rigid cushion base member resting on and supported by said transverse support member in said supine position of said creeper.

3. A transformable creeper comprising a base section and a head section, each of said base section and said head section further comprising a longitudinally extending frame with respective sides having side ends that are adjacent and longitudinally aligned in a supine position of said creeper wherein said base section and said head section are positioned generally in a common plane, said base section having a length greater than the length of said head section;

said frame of said head section further including an end rail that extends transversely between said sides and is disposed opposite said side ends, said end rail has opposed ends, each of said opposed ends of said end rail meeting with one of said sides and forming an elbow section of said frame of said head section;

at least one pair of pivotally mounted arms interconnecting said base section and said head section such that said head section is movable from said supine position to a seating position wherein said head section is disposed above said base section and defines a seat;

a pair of bumper members defined on and vertically depending from said frame of said head section, each said bumper member being spaced apart from said other bumper member and disposed to depend from a different one of said elbow sections of said frame of said head section; and a cushion carried by each of said head section and said base section, said cushions being disposed generally directly adjacent and flush in said supine position of said creeper, said head section including an end member that is longitudinally distanced from said ends of said frame of said head section.

4. The transformable creeper as in claim 3, wherein said end member of said head section is defined at least in part by said head section cushion.

5. A transformable creeper, comprising:

a two-section longitudinally extending frame, said frame comprising a base section and a head section pivotally connected to said base section such that in a supine position of said creeper said base section and said head section are positioned generally in a common plane, and in a seating position said head section is movable from said supine position to a plane that is parallel to and above the plane of said base section;

each of said base section and said head section defining an upper body support surface with transverse ends, said support surfaces being generally flush when said transverse ends are longitudinally aligned in said supine position;

said base section further comprising a transverse support member disposed below said head section in said supine position with at least a portion of said head section supported by said transverse support member in said supine position; and a pair of spaced apart bumper members defined on and vertically depending from said head section.

6. The transformable creeper as in claim 5, further comprising a plurality of rolling members disposed on said base section so that said creeper is rollable in said supine and seat positions.

7. The transformable creeper as in claim 5, wherein said base section and said head section comprise a tubular frame components formed in an open-end configuration having longitudinal sides terminating in side ends, said side ends adjacent and longitudinally aligned in said supine position of said creeper, said transverse support member of said base section disposed across said tubular frame component proximate to and longitudinally distanced from said respective base section side ends, said head section comprising an end member extending between and longitudinally beyond its respective said side ends, said end member supported upon said transverse support member in said supine position of said creeper.

8. The transformable creeper as in claim 7, wherein said body support surfaces comprise cushions.

9. The transformable creeper as in claims 8, wherein said head section cushion comprises a rigid cushion base member that extends longitudinally beyond and transversely inward of said head section side ends, said cushion base member supported upon said transverse support member in said supine position of said creeper.

10. The transformable creeper as in claim 5, further comprising at least one pair of pivotally mounted arms interconnecting said base section and said head section.

11. The transformable creeper as in claim 5, further comprising a safety latch mechanism disposed to releaseably lock said head section in said seating position.

12. A transformable creeper, comprising:

a base section and a head section, each of said base section and said head section further comprising a longitudinally extending frame with respective side rails having side ends that are adjacent and longitudinally aligned in a supine position of said creeper wherein said base section and said head section are positioned generally in a common plane, said base section having a length greater than the length of said head section;

said frame of said head section further including an end rail that extends transversely between said side rails of said head section and is disposed opposite said side ends, said end rail has opposed ends, each of said opposed ends of said end rail meeting with one of said side rails of said head section and forming an elbow section of said frame of said head section, each said elbow section defining a midpoint that is disposed in non-alignment with said end rail of said head section and in non-alignment with said side rails of said head section;

at least one pair of pivotally mounted arms interconnecting said base section and said head section such that said head section is movable from said supine position to a seating position wherein said head section is disposed above said base section and defines a seat;

a support member extending generally across said base section frame proximate to a transverse end of said base section frame;

said head section comprising an end member longitudinally distanced from said side ends of said head section frame and which rests on and is supported by said support member in said supine position such that said head section is supported by said base section frame in said supine position longitudinally distant from said adjacent side ends; and a pair of spaced apart, bumper members defined on and vertically depending from said frame of said head section, each said bumper member being disposed to depend from a different one of said elbow sections of said frame of said head section.

* * * * *